United States Patent [19]

Naito et al.

[11] Patent Number: 4,500,627

[45] Date of Patent: Feb. 19, 1985

[54] HEAT DEVELOPEMENT OF SILVER HALIDE ELEMENT WITH REDOX DYE RELEASER AND FOG REDUCER

[75] Inventors: Hideki Naito; Yoshiharu Yabuki, both of Kanagawa, Japan

[73] Assignee: Fuji Photo Film Co., Ltd., Kanagawa, Japan

[21] Appl. No.: 590,387

[22] Filed: Mar. 16, 1984

[30] Foreign Application Priority Data

Mar. 16, 1983 [JP] Japan ..... 58-43862

[51] Int. Cl.[3] ..... G03C 1/40; G03C 5/54; G03C 5/26

[52] U.S. Cl. ..... 430/203; 430/219; 430/351; 430/607; 430/610; 430/613

[58] Field of Search ..... 430/203, 223, 219, 351, 430/372, 551, 617, 619, 607, 610, 613

[56] References Cited

U.S. PATENT DOCUMENTS 4,463,079 7/1984 Naito et al. ..... 430/203

*Primary Examiner*—Richard L. Schilling

*Attorney, Agent, or Firm*—Sughrue, Mion, Zinn, Macpeak and Seas

[57] ABSTRACT

A process for forming an image which comprises heating a light-sensitive material containing a light-sensitive silver halide and a dye releasing redox compound capable of releasing a hydrophilic dye upon reaction with the light-sensitive silver halide by heating, in a substantially water-free condition in the presence of a compound having at least one group represented by the formula:

wherein $R_1$ and $R_2$ are as defined hereinbefore, is disclosed.

8 Claims, No Drawings

HEAT DEVELOPEMENT OF SILVER HALIDE ELEMENT WITH REDOX DYE RELEASER AND FOG REDUCER

FIELD OF THE INVENTION

This invention relates to a novel process for forming a dye image by heating in a substantially water-free condition. More particularly, this invention relates to a novel process for forming a dye image by using a light-sensitive material containing a dye releasing redox compound which releases a hydrophilic dye upon reaction with a light-sensitive silver halide by heating in a substantially water-free condition.

BACKGROUND OF THE INVENTION

A photographic process utilizing a silver halide has heretofore been widely used due to its excellent photographic characteristics such as sensitivity, control of gradation, etc., as compared with other photographic processes such as an electrophotographic process or a diazo photographic process. In recent years, with respect to image formation process for light-sensitive materials using a silver halide, a technique capable of easily and quickly obtaining an image has been developed by changing the conventional wet development process using, such as, a developing solution, into a dry development process such as a process using heat.

A heat-developable light-sensitive material is known in the art. Such heat-developable light-sensitive materials and processes therefor are described in, for example, *Shashin Kogaku no Kiso,* Corona Co., Ltd., pages 553–555, *Eizo Joho,* April 1978, page 40, *Nebletts Handbook of Photography and Reprography,* 7th Ed., Van Nostrand Reinhold Company, pages 32–33, U.S. Pat. Nos. 3,152,904, 3,301,678, 3,392,020 and 3,457,075, British Pat. Nos. 1,131,108 and 1,167,777, and *Research Disclosure,* June 1978, pages 9–15 (RD-17029).

Various processes for obtaining color images by a dry process have been proposed.

With respect to processes for forming color images by the reaction of an oxidation product of a developing agent with a coupler, it has been proposed to use a p-phenylenediamine type reducing agent and a phenolic coupler or an active methylene coupler as described in U.S. Pat. No. 3,531,286, a p-aminophenol type reducing agent as described in U.S. Pat. No. 3,761,270, a sulfonamidophenol type reducing agent as described in Belgian Pat. No. 802,519 and *Research Disclosure,* pages 31 and 32 (September, 1975) and the combination of a sulfonamidophenol type reducing agent and a 4-equivalent coupler as described in U.S. Pat. No. 4,021,240.

These processes, however, are disadvantageous in that turbid color images are formed, because a reduced silver image and a color image are simultaneously formed on the exposed area after heat-development. In order to eliminate these disadvantages, there have been proposed a process which comprises removing a silver image by liquid processing and a process which comprises transferring only the dye to another layer, for example, a sheet having an image receiving layer. However, the latter process is not desirable because it is not easy to transfer only the dye by distinguishing from unreacted substances.

Another process which comprises introducing a nitrogen-containing heterocyclic group into a dye, forming a silver salt and releasing a dye by heat-development has been proposed in *Research Disclosure,* RD-16966, pages 54–58 (May, 1978). According to this process, clear images can not be obtained because it is difficult to control the release of dyes from non-exposed areas, and thus it is not a generally applicable process.

Further, processes for forming a positive-working color image by a silver dye bleach process utilizing heat, with useful dyes and methods for bleaching are disclosed in, for example, *Research Disclosure,* RD-14433, pages 30–32 (April, 1976), ibid., RD-15227, pages 14–15 (December 1976) and U.S. Pat. No. 4,235,957.

However, these processes require an additional step and an additional material for accelerating bleaching of dyes, for example, heating with a superposed sheet of an activating agent. Furthermore, these processes are disadvantageous in that the resulting color images are gradually reduced and bleached by the coexisting free silver, etc. during storage for a long period of time.

Moreover, a process for forming a color image utilizing a leuco dye has been proposed in, for example, U.S. Pat. Nos. 3,985,565 and 4,022,617. This process is, however, disadvantageous in that it is difficult to stably incorporate the leuco dye in the photographic material and coloration gradually occurs during storage.

In addition, all of the above-described conventional processes generally require the development for a long period of time and the resulting images have high fogging and low density.

SUMMARY OF THE INVENTION

The present invention provides a novel process for forming a dye image by heating in a substantially water-free condition and overcomes the problems encountered in the conventional materials.

Accordingly, an object of the present invention is to provide a light-sensitive material which can form a color image with little fogging by heating in a substantially water-free condition and to provide a novel process for forming a color image utilizing the light-sensitive material.

Another object of the present invention is to provide a process for obtaining a distinct color image by a simple and easy procedure.

These objects of the present invention can be accomplished by a process for forming an image, which comprises heating a light-sensitive material comprising a support having thereon at least a light-sensitive silver halide, a binder and a dye releasing redox compound which is reductive to the light-sensitive silver halide and capable of releasing a hydrophilic dye upon reaction with the light-sensitive silver halide by heating, after imagewise exposure or simultaneously with imagewise exposure, in a substantially water-free condition in the presence of a compound having at least one group represented by the formula (A) or (B):

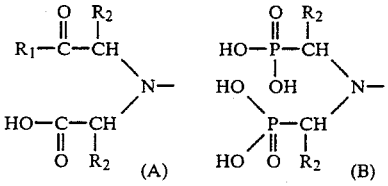

(A) (B)

wherein $R_1$ represents a hydroxyl group, an alkoxy group having 1 to 22 carbon atoms, an alkenyloxy group having 1 to 22 carbon atoms, an aryloxy group having 6 to 22 carbon atoms, an amino group, an N-alkylamino group having 1 to 22 carbon atoms, an N,N-dialkylamino group having 1 to 22 carbon atoms in each alkyl moiety or an N-anilino group, and $R_2$ represents a hydrogen atom or an alkyl group having 1 to 22 carbon atoms (hereinafter simply referred to "compound of the present invention"), to imagewise form a mobile dye. Examples of the aryl group include a phenyl group or a naphthyl group.

DETAILED DESCRIPTION OF THE INVENTION

The other moiety of the compounds of the present invention other than the group represented by the formula (A) or (B) (i.e., the residual group to the compound) include combinations of groups selected from an alkane residue, an alkene residue, a cycloalkane residue, an aromatic residue and a heterocyclic residue.

It is preferable that the compounds of the present invention contain 1 to 6 groups of the formula (A) or (B) in one compound.

In the compounds of the present invention, $R_1$, $R_2$ and the above-described residual groups preferably have a substituent including an alkyl group, a cycloalkyl group, an aralkyl group, an alkoxy group, an aryloxy group, an aryl group, an acylamino group, an acyl group, a cyano group, a hydroxyl group, an alkylsulfonylamino group, an arylsulfonylamino group, an alkylsulfonyl group, an arylsulfonyl group, a hydroxyalkyl group, a cyanoalkyl group, an alkoxycarbonyl group, an aryloxycarbonyl group, an alkoxycarbonylalkyl group, an alkoxyalkyl group, a nitro group, a halogen atom, a sulfamoyl group, an N-substituted sulfamoyl group, a carbamoyl group, an N-substituted carbamoyl group, an acyloxyalkyl group, an amino group, a substituted amino group, an alkylthio group, an arylthio group, a heterocyclic group, an alkoxycarbonylamino group, a carboxyl group and a sulfo group.

Preferred examples of the above-described residual groups are represented by the formula (C):

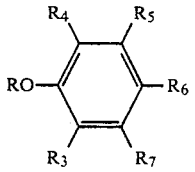

wherein: $R_3$ represents a single chemical bond or a methylene group or a carbonyl group; $R_4$ has the same meaning as defined for $R_3$ and additionally represents a hydrogen atom, an alkyl group, an aryl group or a heterocyclic group; R represents a hydrogen atom or an alkyl group; $R_5$ and $R_7$ each represents a hydrogen atom, an alkyl group or an aryl group, or, when taken together with $R_6$, may form a ring and represents nonmetallic atoms necessary to complete a condensed hetero ring together with the benzene ring; and $R_6$ represents an alkyl group, an aryl group, a hydroxycarbonyl group, an alkylcarbonyl group, an acylamino group, an alkylsulfonyl group, an arylsulfonyl group, a carbamoyl group, a sulfonamido group, an amino group or an alkoxycarbonyl group; and each of R, $R_3$, $R_4$, $R_5$, $R_6$ and $R_7$ may have a substituent.

In addition to the residue of the compound (C), the residual groups of the compounds of the present invention preferably include a substituted or unsubstituted alkyl group, a substituted or unsubstituted alkylene group, a divalent heterocyclic group, a heterocyclic group-substituted methyl group and a substituted or unsubstituted divalent cycloalkyl group. The above substituted or unsubstituted alkylene group may contain in its chain a bonding group composed of an atom other than a carbon atom, e.g., a nitrogen atom or an oxygen atom.

Preferred examples of the compounds which can be used in the present invention are illustrated below, but the present invention will not be limited thereto.

In the following formulae, Z represents a $-CH_2COOH$ group.

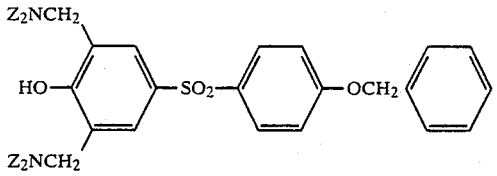

A-1

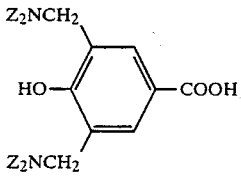

A-2

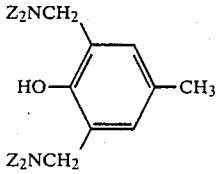

A-3

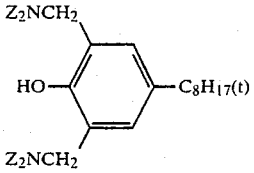

A-4

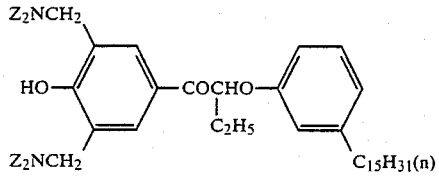

A-5

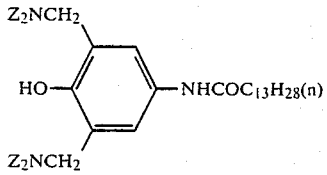

A-6

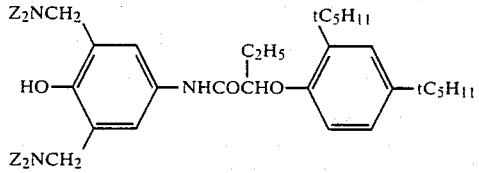

A-7

-continued
A-8
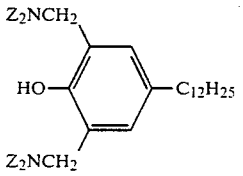
A-9
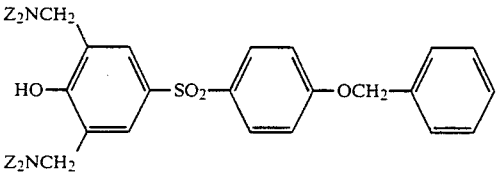
A-10
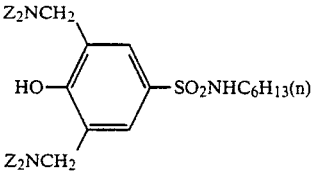
A-11
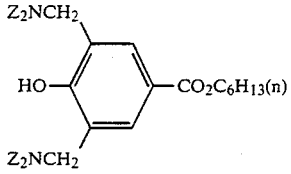
A-12
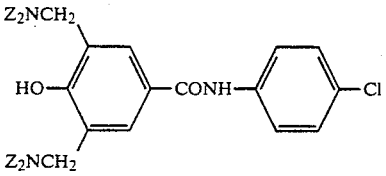
A-13
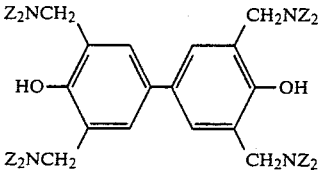
A-14
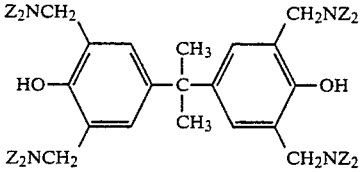
A-15
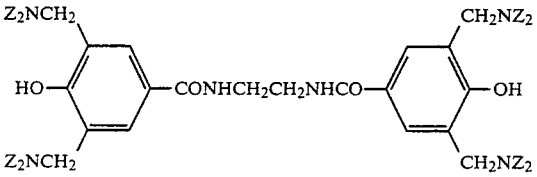
A-16
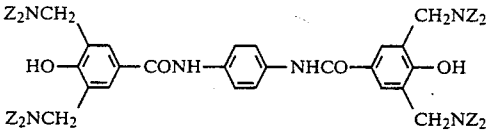
-continued
A-17
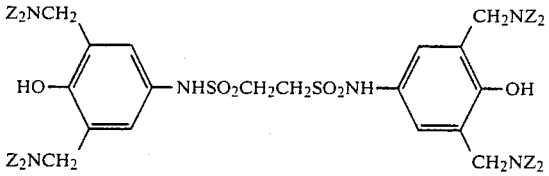
A-18
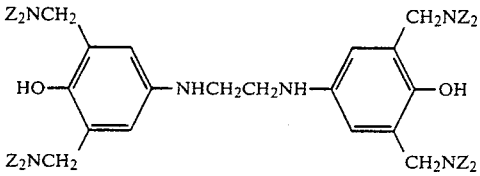
A-19
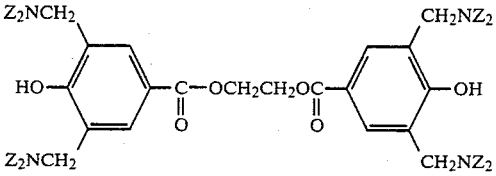
A-20
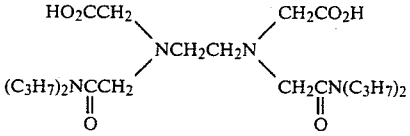
A-21
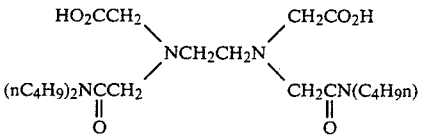
A-22
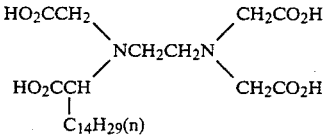
A-23
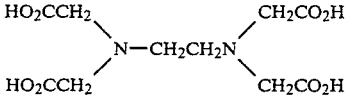
A-24
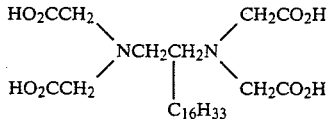
A-25
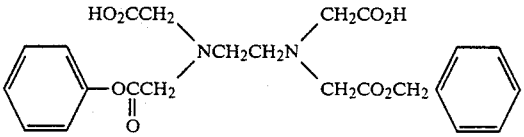
A-26
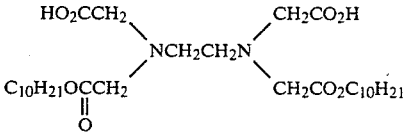

-continued
A-27
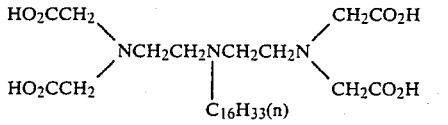
A-28
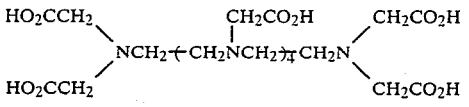
A-29
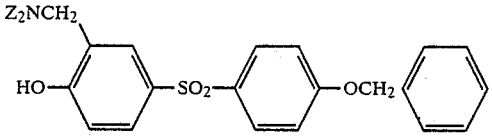
A-30
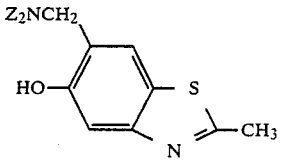
A-31
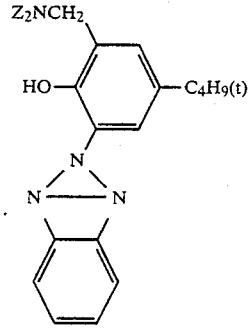
A-32
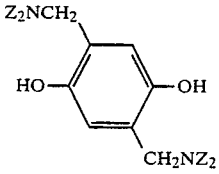
A-33
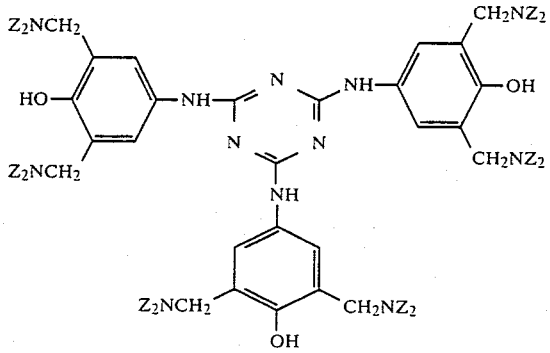
-continued
A-34
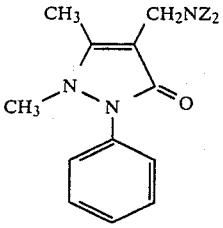
A-35
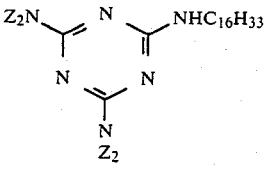
A-36
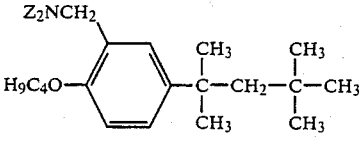
A-37
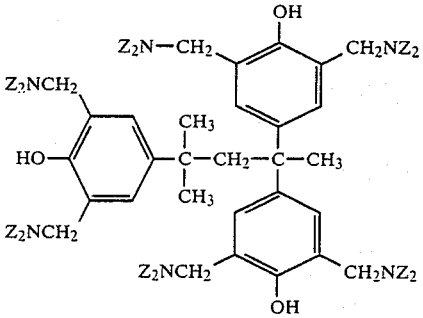
A-38
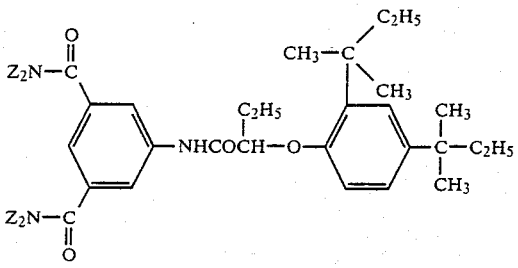
A-39
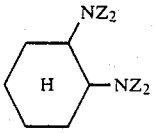
A-40
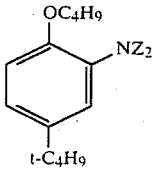
B-1
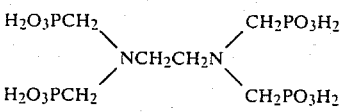

-continued

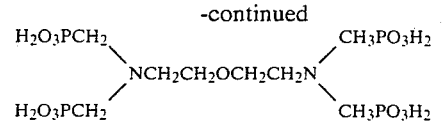

B-2

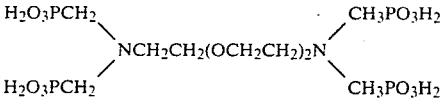

B-3

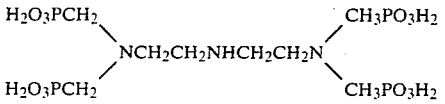

B-4

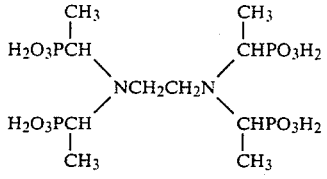

B-5

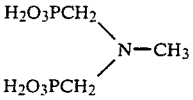

B-6

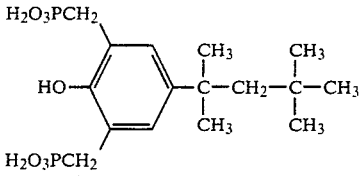

B-7

The compounds of the present invention can be prepared, for example, by N-alkylation [Reaction Scheme (1)], Mannich reaction [Reaction Scheme (2)], ring-opening by anhydrous EDTA [Reaction Scheme (3)], etc. as shown below.

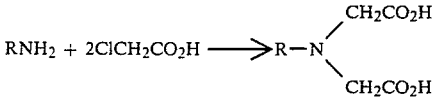

(1)

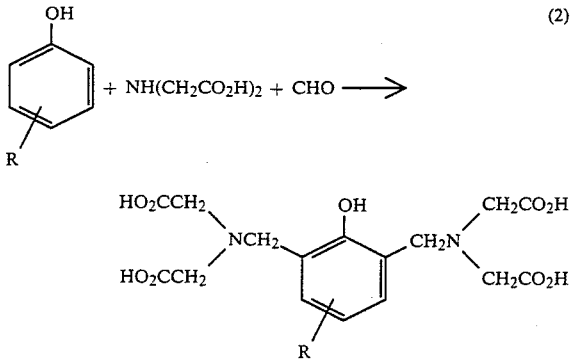

(2)

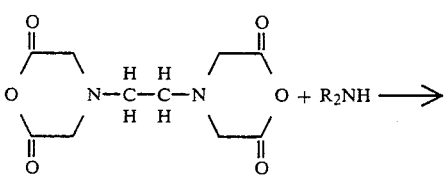

(3)

-continued

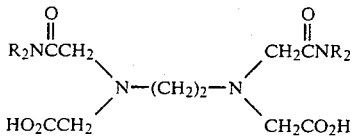

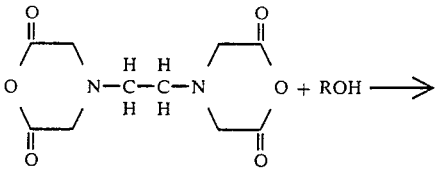

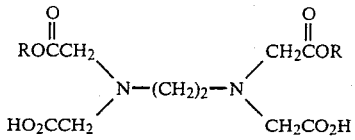

More specifically, the compounds of the present invention can be synthesized according to known processes, such as disclosed in U.S. Pat. Nos. 3,312,552, 3,488,707, 3,458,316 and 3,778,268, British Pat. Nos. 952,162, 1,221,137 and 1,221,138, USSR Pat. No. 717,705, etc.

The process for preparing the compounds of the present invention will be illustrated in greater detail with reference to preparation Examples.

PREPARATION EXAMPLE 1

Preparation of Compound A-13

51.4 g of imidinodiacetic acid and 11.6 g of p-formaldehyde were dissolved in a mixed solvent of 50 ml of water and 70 ml of ethanol. An aqueous solution of 31 g of sodium hydroxide was added to the solution, and an ethanolic solution of 12 g of p,p'-biphenol was then added thereto. After the mixture was heat-refluxed for 4 hours, the reaction mixture was rendered acidic with hydrochloric acid. The precipitated crystals were filtered and washed successively with water and acetone to obtain 39.5 g of the desired compound having a melting point of 195° C. (with yellowing).

PREPARATION EXAMPLE 2

Preparation of Compound A-20

15.7 g of dipropylamine was added dropwise to a solution of 20 g of anhydrous ethylenediaminetetraacetic acid in 350 ml of dioxane over a period of 1 hour under heat-refluxing. The refluxing was further continued for 5 hours. After any insoluble materials were removed by filtration, the reaction solution was cooled and the precipitated crystals were filtered. Recrystallization from 200 ml of dioxane gave 21.1 g of the desired compound having a melting point of 146°–151° C.

Other compounds of the present invention can be prepared in the same manner as described above.

The compounds of the present invention may be used alone or in combination thereof, and can either be added to a light-sensitive material or to a dye fixing material.

The compounds of the present invention can be used in an amount widely ranging from 0.0005 to 20 mols, preferably from 0.001 to 10 mols, per mole of silver of the silver halide.

The compounds of the present invention can be dissolved in a water-miscible organic solvent such as methanol, ethanol, dimethylformamide and the like, and added to a layer in the form of a solution. Alternatively, these compounds can be dissolved in a water-immiscible low boiling point organic solvent such as ethyl acetate, cyclohexanone and the like, or high boiling point organic solvent such as tricresyl phosphate, dibutyl phthalate and the like and added to a layer in the form of an emulsion. In this case, the compound of the present invention may be mixed with a dye releasing redox compound to form an emulsion. Further, the compound of the present invention can be incorporated into a light-sensitive material by a procedure comprising dissolving the compound in an alkaline aqueous solution, adding the solution to an aqueous gelatin solution, and gradually neutralizing the resulting solution with an acid to precipitate microcrystals.

Many of the compounds of the present invention are capable of forming complexes with metals and, therefore, can be incorporated into a light-sensitive material in the form of a metal salt such as a silver salt.

The compounds of the present invention may be added to a layer containing an emulsion or a dispersion of a dye releasing redox compound, or to a protecting layer or an intermediate layer.

It is difficult to specify the mechanism through which the compounds of the present invention act on silver since the compounds of the present invention are effective in an amount over a wide range with respect to silver as described before.

The term "dye image" as used herein includes both the multicolor and monochrome dye images. The monochrome dye image include a monochrome image obtained by mixing two or more dyes.

According to the image formation process of the present invention, a silver image and a mobile dye in the area corresponding to the silver image can be formed simultaneously by merely heating after imagewise exposure. In other words, in the image formation of the present invention, when the light-sensitive material is imagewise exposed and heat-developed in a substantially water-free condition, an oxidation-reduction reaction occurs between the light-sensitive silver halide and a dye releasing redox compound by the action of the exposed light-sensitive silver halide as a catalyst, thereby forming a silver image in the exposed area. In this step, the dye releasing redox compound is oxidized by the silver halide into the corresponding oxidation product. As a result, a hydrophilic mobile dye is released, and the silver image and mobile dye are formed in the exposed area. The presence of a dye releasing aid at this stage accelerates the above-described reaction. By transferring the thus formed mobile dye into, for example, a dye fixing layer, the desired dye image can be obtained.

The above explanation has been made to the case of using a negative-working emulsion. In the case of using an autopositive-working emulsion, the same is applicable with the exception that the silver image and mobile dye are formed in the unexposed area.

The oxidation-reduction reaction between the light-sensitive silver halide and a dye releasing redox compound and the subsequent dye releasing reaction according to the present invention are characterized in that these reactions occur at high temperatures and also in a substantially water-free dry condition. The term "high temperature" as used herein means temperatures of 80° C. or more. The term "substantially water-free condition" means a condition which is in an equilibrium state to the moisture in air but there is no supply of water from the outside of the system. Such a condition is described in *The Theory of the Photographic Process*, page 374, 4th Ed., edited by T. H. James, Macmillian. Sufficient reactivity even in a substantially water-free condition can be confirmed from the fact that a test sample does not decrease its reactivity even if it is vacuum dries at $10^{-3}$ mmHg for one day.

The dye releasing reaction has conventionally been believed to take place by the attack of a nucleophilic reagent and is usually carried out in a liquid having a pH of 10 or more. Therefore, it is unexpected that high reactivity can be attained at high temperatures in a substantially water-free condition. The dye releasing redox compound which can be used in the present invention can undergo an oxidation-reduction reaction with a silver halide without an aid of a so-called auxiliary developing agent. This is an unexpected result which could not be thought of from the knowledge of the convenient wet development system which is carried out at temperatures near ordinary temperature.

The above-described reactions proceed smoothly particularly in the presence of an organic silver salt oxidizing agent, such as silver benzotriazole, to produce a high image density. It is, therefore, particularly preferred in the present invention that such an organic silver salt oxidizing agent be present in the system.

The dye releasing redox compound which releases a hydrophilic diffusible dye used in the present invention is a compound described in European Patent Application (OPI) No. 76,492 as a dye releasing compound and is represented by the following general formula:

$$R_a—SO_2—D$$

wherein $R_a$ represents a reducing group capable of being oxidized by the silver halide; and D represents an image forming dye portion containing a hydrophilic group.

The above-described compound is oxidized corresponding to or reversely corresponding to latent image distributed imagewise in the silver halide and releases imagewise a mobile dye.

The detail definitions of $R_a$ and D, examples of the specific compounds and synthesis examples thereof are described in European Patent Application (OPI) No. 76,492.

As the dye releasing redox compounds used in the present invention, the compounds as described, for example, in U.S. Pat. No. 4,055,428, Japanese Patent Application (OPI) Nos. 12642/81, 16130/81, 16131/81, 650/82 and 4043/82, U.S. Pat. Nos. 3,928,312 and 4,076,592, U.S. Published patent application No. B 351,673, U.S. Pat. Nos. 4,135,929 and 4,198,235, Japanese Patent Application (OPI) No. 46730/78, U.S. Pat. Nos. 4,273,855, 4,149,892, 4,142,891 and 4,258,120, etc., are also effective in addition to the above-described compounds.

Further, the dye releasing redox compounds which release a yellow dye as described, for example, in U.S. Pat. Nos. 4,013,633, 4,156,609, 4,148,641, 4,165,987, 4,148,643, 4,183,755, 4,246,414, 4,268,625 and 4,245,023, Japanese Patent Application (OPI) Nos. 71072/81, 25737/81, 138744/80, 134849/80, 106727/77, 114930/76, etc., can be effectively used in the present invention.

The dye releasing redox compounds which release a magenta dye as described, for example, in U.S. Pat. Nos.

3,954,476, 3,932,380, 3,931,144, 3,932,381, 4,268,624 and 4,255,509, Japanese Patent Application (OPI) Nos. 73057/81, 71060/81, 134850/80, 40402/80, 36804/80, 23628/78, 106727/77, 33142/80 and 53329/80, etc., can be effectively used in the present invention.

The dye releasing redox compounds which release a cyan dye as described, for example, in U.S. Pat. Nos. 3,929,760, 4,013,635, 3,942,987, 4,273,708, 4,148,642, 4,183,754, 4,147,544, 4,165,238, 4,246,414 and 4,268,625, Japanese Patent Application (OPI) Nos. 71061/81, 47823/78, 8827/77 and 143323/78, etc., can be effectively used in the present invention.

Two or more of the dye releasing redox compounds can be used together. In these cases, two or more dye releasing redox compounds may be used together in order to represent the same color or in order to represent black color.

The dye releasing redox compounds are suitably used in a range from 10 mg/m$^2$ to 15 g/m$^2$ and preferably in a range from 20 mg/m$^2$ to 10 g/m$^2$ in a total.

The dye releasing redox compound used in the present invention can be introduced into a layer of the light-sensitive material by known methods such as a method as described in U.S. Pat. No. 2,322,027. In this case, an organic solvent having a high boiling point or an organic solvent having a low boiling point as described below can be used. For example, the dye releasing redox compound is dispersed in a hydrophilic colloid after dissolved in an organic solvent having a high boiling point, for example, a phthalic acid alkyl ester (for example, dibutyl phthalate, dioctyl phthalate, etc.), a phosphoric acid ester (for example, diphenyl phosphate, triphenyl phosphate, tricresyl phosphate, dioctylbutyl phosphate, etc.), a citric acid ester (for example, tributyl acetylcitrate, etc.), a benzoic acid ester (for example, octyl benzoate, etc.), an alkylamide (for example, diethyl laurylamide, etc.), an aliphatic acid ester (for example, dibutoxyethyl succinate, dioctyl azelate, etc.), a trimesic acid ester (for example, tributyl trimesate, etc.), etc., or an organic solvent having a boiling point of about 30° C. to 160° C., for example, a lower alkyl acetate such as ethyl acetate, butyl acetate, etc., ethyl propionate, secondary butyl alcohol, methyl isobutyl ketone, $\beta$-ethoxyethyl acetate, methyl cellosolve acetate, cyclohexanone, etc. The above-described organic solvents having a high boiling point and organic solvents having a low boiling point may be used as a mixture thereof.

Further, it is possible to use a dispersion method using a polymer as described in Japanese Patent Publication No. 39853/76 and Japanese Patent Application (OPI) No. 59943/76. Moreover, various surface active agents can be used when the dye releasing redox compound is dispersed in a hydrophilic colloid. For this purpose, the surface active agents illustrated in other part of the specification can be used.

In the present invention, if necessary, a reducing agent may be used. The reducing agent in this case is the so-called auxiliary developing agent, which is oxidized by the silver halide and/or the organic silver salt oxidizing agent to form its oxidized product having an ability to oxidize the reducing group $R_a$ in the dye releasing redox compound.

Examples of useful auxiliary developing agents include the compounds specifically described in European Patent Application (OPI) No. 76,492.

The silver halide used in the present invention includes silver chloride, silver chlorobromide, silver chloroiodide, silver bromide, silver iodobromide, silver chloroiodobromide and silver iodide, etc.

In the embodiment of the present invention in which the organic silver salt oxidizing agent is not used together with but the silver halide is used alone, particularly preferred silver halide is silver halide partially containing a silver iodide crystal in its grain. That is, the silver halide which shows the X-ray diffraction pattern of pure silver iodide is particularly preferred.

In photographic materials a silver halide containing two or more kinds of halogen atoms can be used. Such a silver halide is present in the form of a completely mixed crystal in a conventional silver halide emulsion. For example, the grain of silver iodobromide shows X-ray diffraction pattern at a position corresponding to the mixed ratio of silver iodide crystal and silver bromide crystal but not at a position corresponding to pure silver iodide crystal and pure silver bromide crystal separately.

Particularly preferred examples of silver halide use in the present invention include silver chloroiodide, silver iodobromide, and silver chloroiodobromide each containing silver iodide crystal in its grain and showing X-ray diffraction pattern of silver iodide crystal.

The process for preparing those silver halides is explained taking the case of silver iodobromide. That is, the silver iodobromide is prepared by first adding silver nitrate solution to potassium bromide solution to form silver bromide particles and then adding potassium iodide to the mixture.

Two or more kinds of silver halides in which a particle size and/or a halogen composition are different from each other may be used in mixture.

An average particle size of the silver halide used in the present invention is preferably from 0.001 $\mu$m to 10 $\mu$m and more preferably from 0.001 $\mu$m to 5 $\mu$m.

The silver halide used in the present invention may be used as is. However, it may be chemically sensitized with a chemical sensitizing agent such as compounds or sulfur, selenium or tellurium, etc., or compounds of gold, platinum, palladium, rhodium or iridium, etc., a reducing agent such as tin halide, etc., or a combination thereof. The details thereof are described in T. H. James, *The Theory of the Photographic Process,* The Fourth Edition, Chapter 5, pages 149 to 169.

In the particularly preferred embodiment of the present invention, an organic silver salt oxidizing agent is used together. The organic silver salt oxidizing agent is a silver salt which forms a silver image by reacting with the above-described image forming substance or a reducing agent coexisting, if necessary, with the image forming substance, when it is heated to a temperature of above 80° C. and, preferably, above 100° C. in the presence of exposed silver halide. By coexisting the organic silver salt oxidizing agent, the light-sensitive material which provides higher color density can be obtained.

The silver halide used in this case is not always necessarily to have the characteristic in that the silver halide contains pure silver iodide crystal in the case of using the silver halide alone. Any silver halide which is known in the art can be used.

Examples of such organic silver salt oxidizing agents include those described in European Patent Application (OPI) No. 76,492.

A silver salt of an organic compound having a carboxy group can be used. Typical examples thereof include a silver salt of an aliphatic carboxylic acid and a silver salt of an aromatic carboxylic acid.

In addition, a silver salt of a compound containing a mercapto group or a thione group and a derivative thereof can be used.

Further, a silver salt of a compound containing an imino group can be used. Examples of these compounds include a silver salt of benzotriazole and a derivative thereof as described in Japanese Patent Publication Nos. 30270/69 and 18416/70, for example, a silver salt of benzotriazole, a silver salt of alkyl substituted benzotriazole such as a silver salt of methylbenzotriazole, etc., a silver salt of a halogen substituted benzotriazole such as a silver salt of 5-chlorobenzotriazole, etc., a silver salt of carboimidobenzotriazole such as a silver salt of butylcarboimidobenzotriazole, etc., a silver salt of 1,2,4-triazole or 1-H-tetrazole as described in U.S. Pat. No. 4,220,709, a silver salt of carbazole, a silver salt of saccharin, a silver salt of imidazole and an imidazole derivative, and the like.

Moreover, a silver salt as described in *Research Disclosure,* Vol. 170, No. 17029 (June, 1978) and an organic metal salt such as copper stearate, etc., are the organic metal salt oxidizing agent capable of being used in the present invention.

Methods of preparing these silver halide and organic silver salt oxidizing agents and manners of blending them are described in *Research Disclosure,* No. 17029, Japanese Patent Application (OPI) Nos. 32928/75 and 42529/76, U.S. Pat. No. 3,700,458, and Japanese Patent Application (OPI) Nos. 13224/74 and 17216/75.

A suitable coating amount of the light-sensitive silver halide and the organic silver salt oxidizing agent employed in the present invention is in a total of from 50 $mg/m^2$ to 10 $g/m^2$ calculated as an amount of silver.

The light-sensitive silver halide and the organic silver salt oxidizing agent used in the present invention are prepared in the binder as described below. Further, the dye releasing redox compound is dispersed in the binder described below.

The binder which can be used in the present invention can be employed individually or in a combination thereof. A hydrophilic binder can be used as the binder according to the present invention. The typical hydrophilic binder is a transparent or translucent hydrophilic colloid, examples of which include a natural substance, for example, protein such as gelatin, a gelatin derivative, etc., a cellulose derivative, a polysaccharide such as starch, gum arabic, etc., and a synthetic polymer, for example, a water-soluble polyvinyl compound such as polyvinyl alcohol, polyvinyl pyrrolidone, acrylamide polymer, etc. Another example of the synthetic polymer compound is a dispersed vinyl compound in a latex form which is used for the purpose of increasing dimensional stability of a photographic material.

The silver halide used in the present invention can be spectrally sensitized with methine dyes or other dyes. Suitable dyes which can be employed include cyanine dyes, merocyanine dyes, complex cyanine dyes, complex merocyanine dyes, holopolar cyanine dyes, hemicyanine dyes, styryl dyes, and hemioxonol dyes. Of these dyes, cyanine dyes, merocyanine dyes and complex merocyanine dyes are particularly useful. Any conventionally utilized nucleus for cyanine dyes, such as basic heterocyclic nuclei, can be contained in these dyes. That is, a pyrroline nucleus, an oxazoline nucleus, a thiazoline nucleus, a pyrrole nucleus, an oxazole nucleus, a thiazole nucleus, a selenazole nucleus, an imidazole nucleus, a tetrazole nucleus, a pyridine nucleus, etc., and further, nuclei formed by condensing alicyclic hydrocarbon rings with these nuclei and nuclei formed by condensing aromatic hydrocarbon rings with these nuclei, that is, an indolenine nucleus, a benzindolenine nucleus, an indole nucleus, a benzoxazole nucleus, a naphthoxazole nucleus, a benzothiazole nucleus, a naphthothiazole nucleus, a benzoselenazole nucleus, a benzimidazole nucleus, a quinoline nucleus, etc., are appropriate. The carbon atoms of these nuclei may also be substituted.

As nuclei having a ketomethylene structure, 5- or 6-membered heterocyclic nuclei such as a pyrazolin-5-one nucleus, a thiohydantoin nucleus, a 2-thiooxazolidin-2,4-dione nucleus, a thiazolidin-2,4-dione nucleus, a rhodanine nucleus, a thiobarbituric acid nucleus, etc., may also be used in merocyanine dyes and complex merocyanine dyes.

These sensitizing dyes can be employed individually, and can also be employed in combination thereof. A combination of sensitizing dyes is often used, particularly for the purpose of supersensitization. Representative examples thereof are described in U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,769,301, 3,814,609, 3,837,862 and 4,026,707, British Pat. Nos. 1,344,281 and 1,507,803, Japanese Patent Publication Nos. 4936/68 and 12375/78, Japanese Patent Application (OPI) Nos. 110618/77 and 109925/77, etc.

The sensitizing dyes may be present in the emulsion together with dyes which themselves do not give rise to spectrally sensitizing effects but exhibit a supersensitizing effect or materials which do not substantially absorb visible light but exhibit a supersensitizing effect. For example, aminostilbene compounds substituted with a nitrogen-containing heterocyclic group (e.g., those described in U.S. Pat. Nos. 2,933,390 and 3,635,721), aromatic organic acid-formaldehyde condensates (e.g., those described in U.S. Pat. No. 3,743,510), cadmium salts, azaindene compounds, etc., can be present. The combinations described in U.S. Pat. Nos. 3,615,613, 3,615,641, 3,617,295 and 3,635,721 are particularly useful.

A support used in the light-sensitive material or used as the dye fixing material, if desired, according to the present invention is that which can endure at the processing temperature. As an ordinary support, not only glass, paper, metal or analogues thereto may be used, but also an acetyl cellulose film, a cellulose ester film, a polyvinyl acetal film, a polystyrene film, a polycarbonate film, a polyethylene terephthalate film, and a film related thereto or a plastic material may be used. Further, a paper support laminated with a polymer such as polyethylene, etc., can be used. The polyesters described in U.S. Pat. Nos. 3,634,089 and 3,725,070 are preferably used.

In the present invention, various kinds of dye releasing activators can be used. The dye releasing activator means a substance which accelerates the oxidation-reduction reaction between the light-sensitive silver halide and/or the organic silver salt oxidizing agent and dye releasing redox compound, or accelerates release of a dye by means of its nucleophilic action to the oxidized dye releasing redox compound in the dye releasing reaction subsequently occurred, and a base and a base precursor can be used. It is particularly advantageous to use these dye releasing activators in order to accelerate the reactions in the present invention.

Examples of preferred bases are amines which include trialkylamines, hydroxylamines, aliphatic polyamines, N-alkyl substituted aromatic amines, N-hydroxyalkyl substituted aromatic amines and bis[p-(dialkylamino)phenyl]methanes. Further, betaine tetramethylammonium iodide and diaminobutane dihydrochloride as described in U.S. Pat. No. 2,410,644, and urea and organic compounds including amino acids such as 6-aminocaproic acid as described in U.S. Pat. No. 3,506,444 are useful. The base precursor is a substance which releases a basic component by heating. Examples of typical base precursors are described in British Pat. No. 998,949. A preferred base precursor is a salt of a carboxylic acid and an organic base, and examples of the suitable carboxylic acids include trichloroacetic acid and trifluoroacetic acid and examples of the suitable bases include guanidine, piperidine, morpholine, p-toluidine and 2-picoline, etc. Guanidine trichloroacetate as described in U.S. Pat. No. 3,220,846 is particularly preferred. Further, aldonic amides as described in Japanese Patent Application (OPI) No. 22625/75 are preferably used because they decompose at a high temperature to form bases.

These dye releasing activators can be used in an amount of a broad range. A useful range is up to 50% by weight based on the amount of a dry layer coated of the light-sensitive material. A range of 0.01% by weight to 40% by weight is more preferred.

It is advantageous to use a compound represented by the general formula described below in the heat-developable color photographic material in order to accelerate development and accelerate release of a dye.

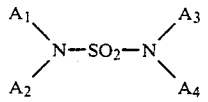

(A)

wherein $A_1$, $A_2$, $A_3$ and $A_4$, which may be the same or different, each represents a hydrogen atom or a substituent selected from an alkyl group, a substituted alkyl group, a cycloalkyl group, an aralkyl group, an aryl group, a substituted aryl group and a heterocyclic group; and $A_1$ and $A_2$ or $A_3$ and $A_4$ may combine with each other to form a ring.

The above-described compound can be used in an amount of broad range. A useful range is up to 20% by weight based on the amount of a dry layer coated of the light-sensitive material. A range of 0.1% by weight to 15% by weight is more preferred.

It is advantageous to use a water releasing compound in the present invention in order to accelerate the dye releasing reaction.

The water releasing compound means a compound which releases water by decomposition during heat development. These compounds are particularly known in the field of printing of fabrics, and $NH_4Fe(SO_4)_2.12H_2O$, etc., as described in Japanese Patent Application (OPI) No. 88386/75 are useful.

Further, in the present invention, it is possible to use a compound which activates development and stabilizes the image at the same time. Particularly, it is preferred to use isothiouroniums including 2-hydroxyethylisothiuronium trichloroacetate as described in U.S. Pat. No. 3,301,678, bisisothiuroniums including 1,8-(3,6-dioxaoctane)bis(isothiuronium trifluoroacetate), etc., as described in U.S. Pat. No. 3,669,670, thiol compounds as described in German Patent Application (OLS) No. 2,162,714, thiazolium compounds such as 2-amino-2-thiazolium trichloroacetate, 2-amino-5-bromoethyl-2-thiazolium trichloroacetate, etc., as described in U.S. Pat. No. 4,012,260, compounds having α-sulfonyl-acetate as an acid part such as bis(2-amino-2-thiazolium)-methylene-bis(sulfonylacetate), 2-amino-2-thiazolium phenylsulfonylacetate, etc., as described in U.S. Pat. No. 4,060,420, and compounds having 2-carboxycarboxamide as an acid part as described in U.S. Pat. No. 4,088,496.

In the present invention, it is possible to use a thermal solvent. The term "thermal solvent" means a non-hydrolyzable organic material which melts at a temperature of heat treatment and melts at a lower temperature of heat treatment when it is present together with other components. Preferred examples of thermal solvents include compounds which can act as a solvent for the developing agent and compounds having a high dielectric constant which accelerate physical development of silver salts. Examples of preferred thermal solvents include those described in European Patent Application (OPI) No. 76,492.

In the present invention, though it is not always necessary to further incorporate substances or dyes for preventing irradiation or halation in the light-sensitive material, because the light-sensitive material is colored by the dye releasing redox compound, it is possible to add filter dyes or light absorbing materials, etc., into the light-sensitive material, as described in Japanese Patent Publication No. 3692/73 and U.S. Pat. Nos. 3,253,921, 2,527,583 and 2,956,879, etc., in order to further improve sharpness. It is preferred that these dyes have a thermal bleaching property. For example, dyes as described in U.S. Pat. Nos. 3,769,019, 3,745,009 and 3,615,432 are preferred.

The light-sensitive material used in the present invention may contain, if necessary, various additives known for the heat-developable light-sensitive materials and may have a layer other than the light-sensitive layer, for example, an antistatic layer, an electrically conductive layer, a protective layer, an intermediate layer, an anti-halation layer, a strippable layer, etc.

The photographic emulsion layer and other hydrophilic colloid layers in the light-sensitive material of the present invention may contain various surface active agents for various purposes, for example, as coating aids, or for prevention of electrically charging, improvement of lubricating property, emulsification, prevention of adhesion, improvement of photographic properties (for example, acceleration of development, rendering hard tone or sensitization), etc.

For example, it is possible to use nonionic surface active agents such as saponin (steroid saponin), alkylene oxide derivatives (for example, polyethylene glycol, polyethylene glycol/polypropylene glycol condensates, polyethylene glycol alkyl ethers or polyethylene glycol alkylaryl ethers, polyethylene glycol esters, polyethylene glycol sorbitan esters, polyalkylene glycol alkylamines or amides, polyethylene oxide adducts of silicone, etc.), glycidol derivatives (for example, alkenylsuccinic acid polyglycerides, alkylphenol polyglycerides, etc.), polyhydric alcohol aliphatic acid esters or saccharide alkyl esters, etc.; anionic surface active agents containing acid groups such as a carboxy group, a sulfo group, a phospho group, a sulfate group, a phosphate group, etc., such as alkylcarboxylic acid salts, alkylsulfonate salts, alkylbenzenesulfonate salts, alkylnaphthalenesulfonate salts, alkyl sulfuric acid esters, alkylphosphoric acid esters, N-acyl-N-alkyltaurines, sulfosuccinic acid esters, sulfoalkyl polyoxyethylene alkylphenyl ethers, polyoxyethylene alkylphosphoric acid esters, etc.; ampholytic surface active agents such as amino acids, aminoalkylsulfonic acids, aminoalkylsulfuric acid esters or phosphoric acid esters, alkylbetaines, amine oxides, etc.; and cationic surface active agents such as alkylamine salts, aliphatic or aromatic quaternary ammonium salts, heterocyclic quaternary ammonium salts such as pyridinium salts, imidazolium salts, etc., aliphatic or heterocyclic phosphonium salts, aliphatic or heterocyclic sulfonium salts, etc.

Of the above-described surface active agents, polyethylene glycol type nonionic surface active agents having a recurring unit of ethylene oxide in their molecules may be preferably incorporated into the light-sensitive material. It is particularly preferred that the molecule contains 5 or more of the recurring units of ethylene oxide.

The nonionic surface active agents capable of satisfying the above-described conditions are well known as to their structures, properties and methods of synthesis. These nonionic surface active agents are widely used even outside this field. Representative references relating to these agents include: *Surfactant Science Series,* Vol. 1, Nonionic Surfactants (edited by Martin J. Schick, Marcel Dekker Inc., 1967), and *Surface Active Ethylene Oxide Adducts* (edited by Schoufeldt N. Pergamon Press, 1969). Among the nonionic surface active agents described in the above-mentioned references, those capable of satisfying the above-described conditions are preferably employed in connection with the present invention.

The nonionic surface active agents can be used individually or as a mixture of two or more of them.

The polyethylene glycol type nonionic surface active agents can be used in an amount of less than 100% by weight, preferably less than 50% by weight, based on a hydrophilic binder.

The light-sensitive material of the present invention may contain a cationic compound containing a pyridinium salt. Examples of the cationic compounds containing a pyridinium group used are described in PSA Journal Section B 36 (1953), U.S. Pat. Nos. 2,648,604 and 3,671,247, Japanese Patent Publication Nos. 30074/69 and 9503/69, etc.

In the photographic light-sensitive material and the dye fixing material of the present invention, the photographic emulsion layer and other binder layers may contain inorganic or organic hardeners. It is possible to use chromium salts (chromium alum, chromium acetate, etc.), aldehydes (formaldehyde, glyoxal, glutaraldehyde, etc.), N-methylol compounds (dimethylolurea, methylol dimethylhydantoin, etc.), dioxane derivatives (2,3-dihydroxydioxane, etc.), active vinyl compounds (1,3,5-triacryloylhexahydro-s-triazine, 1,3-vinylsulfonyl-2-propanol, etc.), active halogen compounds (2,4-dichloro-6-hydroxy-s-triazine, etc.), mucohalogenic acids (mucochloric acid, mucophenoxychloric acid, etc.), etc., which are used individually or as a combination thereof.

Examples of various additives include those described in *Research Disclosure,* Vol. 170, No. 17029 (June, 1978), for example, plasticizers, dyes for improving sharpness, antihalation dyes, sensitizing dyes, matting agents, fluorescent whitening agents and fading preventing agents, etc.

If necessary, two or more layers may be coated at the same time by the method as described in U.S. Pat. No. 2,761,791 and British Pat. No. 837,095.

Various means for exposure can be used in the present invention. Latent images are obtained by imagewise exposure by radiant rays including visible rays. Generally, light sources used in this invention include tungsten lamps, mercury lamps, halogen lamps such as iodine lamps, xenon lamps, laser light sources, CRT light sources, fluorescent tubes and light-emitting diodes, etc.

In the present invention, after the heat-developable color photographic material is exposed to light, the resulting latent image can be developed by heating the whole material to a suitably elevated temperature, for example, about 80° C. to about 250° C. for about 0.5 second to about 300 seconds. A higher temperature or lower temperature can be utilized to prolong or shorten the heating time, if it is within the above-described temperature range. Particularly, a temperature range of about 110° C. to about 160° C. is useful.

As the heating means, a simple heat plate, iron, heat roller, heat generator utilizing carbon or titanium white, etc., or analogues thereto may be used.

In the present invention, a specific method for forming a color image by heat development comprises transfer of a hydrophilic mobile dye. For this purpose, the heat-developable color photographic material of the present invention is composed of a support having thereon a light-sensitive layer (I) containing at least silver halide, if necessary, an organic silver salt oxidizing agent, a dye releasing redox compound which is also a reducing agent for the organic silver salt oxidizing agent and a binder, and a dye fixing layer (II) capable of receiving the hydrophilic diffusible dye formed in the light-sensitive layer (I).

The above-described light-sensitive layer (I) and the dye fixing layer (II) may be formed on the same support, or they may be formed on different supports, respectively. The dye fixing layer (II) can be stripped off the light-sensitive layer (I). For example, after the heat-developable color photographic material is exposed imagewise to light, it is developed by heating uniformly and thereafter the dye fixing layer (II) or the light-sensitive layer (I) is peeled apart. Also, when a light-sensitive material having the light-sensitive layer coated on a support and a fixing material having the dye fixing layer (II) coated on a support are separately formed, after the light-sensitive material is exposed imagewise to light and uniformly heated, the mobile dye can be transferred on the dye fixing layer (II) by superposing the fixing material on the light-sensitive layer.

Further, there is a method wherein only the light-sensitive layer (I) is exposed imagewise to light and heated uniformly by superposing the dye fixing layer (II) on the light-sensitive layer (I).

The dye fixing layer (II) can contain, for example, a dye mordant in order to fix the dye. In the present invention, various mordants can be used, and polymer mordants are particularly preferred. In addition to the mordants, the dye fixing layer may contain the bases, base precursors and thermal solvents. In particular, it is particularly preferred to incorporate the bases or base precursors into the dye fixing layer (II) in the cases wherein the light-sensitive layer (I) and the dye fixing layer are formed on different supports.

Preferred polymer mordants used in the present invention can be polymers containing secondary and tertiary amino groups, polymers containing nitrogen-containing heterocyclic moieties, polymers having quaternary cation groups thereof, having a molecular weight of from 5,000 to 200,000, and particularly from 10,000 to 50,000.

For example, vinylpyridine polymers and vinylpyridinium cation polymers as disclosed in U.S. Pat. Nos. 2,548,564, 2,484,430, 3,148,061 and 3,756,814, etc., polymer mordants capable of cross-linking with gelatin as disclosed in U.S. Pat. Nos. 3,625,694, 3,859,096 and 4,128,538, British Pat. No. 1,277,453, etc., aqueous sol type mordants as disclosed in U.S. Pat. Nos. 3,958,995, 2,721,852 and 2,798,063, Japanese Patent Application (OPI) Nos. 115228/79, 145529/79 and 126027/79, etc., water-insoluble mordants as disclosed in U.S. Pat. No. 3,898,088, etc., reactive mordants capable of forming cobalent bonds with dyes used as disclosed in U.S. Pat. No. 4,168,976 (Japanese Patent Application (OPI) No. 137333/79), etc., and mordants disclosed in U.S. Pat. Nos. 3,709,690, 3,788,855, 3,642,482, 3,488,706, 3,557,066, 3,271,147 and 3,271,148, Japanese Patent Application (OPI) Nos. 71332/75, 30328/78, 155528/77, 125/78 and 1024/78, etc., can be illustrated.

In addition, mordants disclosed in U.S. Pat. Nos. 2,675,316 and 2,882,156 can be used.

The dye fixing layer (II) can have a white reflective layer. For example, a layer of titanium dioxide dispersed in gelatin can be provided on the mordant layer on a transparent support. The layer of titanium dioxide forms a white opaque layer, by which reflection color images of the transferred color images which can be observed through the transparent support is obtained.

Typical dye fixing material used in the present invention is obtained by mixing the polymer containing ammonium salt groups with gelatin and applying the mixture to a transparent support.

The transfer of dyes from the light-sensitive layer to the dye fixing layer can be carried out using a dye transfer assistant. Examples of useful dye transfer assistant include water and an alkaline aqueous solution containing sodium hydroxide, potassium hydroxide and an inorganic alkali metal salt. Further, a solvent having a low boiling point such as methanol, N,N-dimethylformamide, acetone, diisobutyl ketone, etc., and a mixture of such a solvent having a low boiling point with water or an alkaline aqueous solution can be used. The dye transfer assistant ca be employed by wetting the image receiving layer with the transfer assistant or by incorporating it in the form of water of crystallization or microcapsules into the material.

EXAMPLE 1

A method for preparing a silver iodobromide emulsion is described below.

40 g of gelatin and 26 g of potassium bromide were dissolved in 3,000 ml of water, and the solution was stirred while maintaining the temperature at 50° C. A solution containing 34 g of silver nitrate dissolved in 200 ml of water was then added thereto over a period of 10 minutes. Subsequently, a solution of 3.3 g potassium iodide dissolved in 100 ml of water was added thereto over a period of 2 minutes.

By controlling the pH of the silver iodobromide emulsion thus prepared, precipitates were formed, and excess salts were removed. The pH of the emulsion was then adjusted to 6.0 and 400 g of the silver iodobromide emulsion was obtained.

A method for preparing a silver benzotriazole emulsion is described below.

28 g of gelatin and 13.2 g of benzotriazole were dissolved in 3,000 ml of water, and the solution was stirred while maintaining the temperature at 40° C. To the resulting solution was added a solution of 17 g of silver nitrate dissolved in 100 ml of water over a period of 2 minutes.

The pH of the resulting silver benzotriazole emulsion was controlled to cause precipitation and excess salts were removed. The pH of the emulsion was then adjusted to 6.0, and a silver benzotriazole emulsion was obtained in a yield of 400 g.

A method of preparing a gelatin dispersion of a dye releasing redox compound is described below.

5 g of a magenta dye releasing redox compound of the formula:

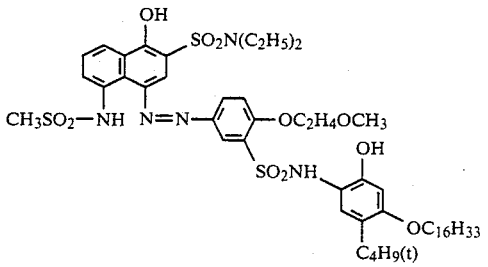

0.15 g of Compound A-13 of the present invention, 0.5 g of sodium 2-ethylhexylsuccinate sulfonate and 5 g of tricresyl phosphate (TCP) were weighed and dissolved in 3 ml of dimethylformamide and 30 ml of ethyl acetate under heating at about 60° C. to prepare a uniform solution. This solution was mixed with 100 g of a 10% aqueous solution of lime-treated gelatin by stirring and then dispersed using a homogenizer at 10,000 rpm for 10 minutes. This dispersion is designated as Dispersion I. Dispersion II was prepared in the same manner as described above except that Compound A-13 of the present invention was not used.

A method of preparing light-sensitive materials A and B is described below.

| Light-Sensitive Material A: | | |
|---|---|---|
| (a) | Silver iodobromide emulsion (as prepared above) | 25 g |
| (b) | Dispersion I | 33 g |
| (c) | 5% Aqueous solution of a compound of the formula: 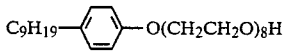  | 5 ml |
| (d) | 10% Ethanol solution of guanidine-trichloroacetic acid | 12 ml |
| (e) | 10% Aqueous solution of dimethylsulfamide | 4 ml |
| (f) | Water | 8 ml |

The above components (a) to (f) were mixed and dissolved, and the resulting solution was coated on a polyethylene terephthalate film in a wet thickness of 30 μm and dried. On the resulting coated film was further coated the follow composition as a protecting layer in a wet thickness of 25 μm followed by drying to obtain a Light-Sensitive Material A.

| | | |
|---|---|---|
| (i) | 10% Aqueous solution of gelatin | 35 g |
| (ii) | 10% Ethanol solution of guanidine-trichloroacetic acid | 5 ml |
| (iii) | 1% Aqueous solution of sodium 2-ethylhexylsuccinate sulfonate | 4 ml |
| (iv) | Water | 56 ml |
| Light-Sensitive Material B: | | |
| (a) | Silver benzotriazole emulsion (as prepared above) | 10 g |
| (b) | Silver iodobromide emulsion (as prepared above) | 20 g |
| (c) | Dispersion I | 33 g |
| (d) | 5% Aqueous solution of a compound of the formula: 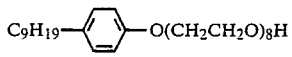 | 5 ml |
| (e) | 1% Ethanol solution of guanidine-trichloroacetic acid | 12.5 ml |
| (f) | 10% Aqueous solution of dimethylsulfamide | 4 ml |
| (g) | Water | 7.5 ml |

The above components (a) to (g) were mixed and dissolved, and the resulting solution was coated on a polyethylene terephahalate film in a wet thickness of 30 μm, followed by drying. A protecting layer was formed on the coated film in the same manner as described above for the preparation of Light-Sensitive Material A.

For comparison, Light-Sensitive Materials C and D were prepared in the same manner as described above for the preparation of Light-Sensitive Materials A and B, respectively, except that Disperson II was used in place of Dispersion I.

A method for preparing a dye fixing material is described below.

10 g of poly(methyl acrylate-co-N,N,N-trimethyl-N-vinylbenzylammonium chloride) (the ratio of methyl acrylate to vinylbenzylammonium chloride was 1:1) was dissolved in 200 ml of water, and the solution was uniformly mixed with 100 g of a 10% aqueous solution of lime-treated gelatin. The resulting mixture was uniformly coated in a wet thickness of 90 μm on a paper support which had been laminated with a titanium dioxide-dispersed polyethylene. The resulting sample was dried and then used as a dye fixing material having a mordant layer.

The above prepared Light-Sensitive Materials A, B, C and D were imagewise exposed at a 2,000 lux for 10 seconds using a tungsten lamp and then uniformly heated on a heat block set at 140° C. for 20 minutes.

Then, the above-described dye fixing material was dipped in water and the wet dye fixing material and the above heated Light-Sensitive Materials A, B, C or D were laminated with each other in such a manner that the coating layer of the two materials were in contact with each other. Thereafter, the resulting laminated material was heated on a heat block set at 80° C. for 6 seconds, and the dye fixing material was peeled off from the light-sensitive material, whereby a negative-working magenta color image was formed on the dye fixing material. The density of this negative image to green light was determined by use of a Macbeth reflection densitometer (RD 519). The results obtained are shown in Table 1 below.

TABLE 1

| Light-Sensitive Material | Compound of Invention | $D_{max}$ | $D_{min}$ | Gradation* |
|---|---|---|---|---|
| A | A-13 | 1.90 | 0.11 | 1.6 |
| B | A-13 | 2.08 | 0.12 | 1.7 |
| C | none | 1.97 | 0.23 | 1.6 |
| D | none | 2.16 | 0.25 | 1.7 |

*Note:
With respect to 10 times the amount of exposure in the linear portion.

From the above results shown in Table 1 it can be seen that Compound A-13 of the present invention provides a distinct image with reduced fog formation but without substantially decreasing the maximum density.

EXAMPLE 2

Dispersions III, IV, V, VI and VII were prepared in the same manner as in Example 1 except that 0.15 g each of Compounds A-1, A-4, A-5, A-20 and B-1 of the present invention was used, respectively, in place of Compound A-13 of the present invention.

By using the thus obtained Dispersions III to VII, Light-Sensitive Materials E, F, G, H and I were prepared, respectively, in the same manner as described for the preparation of Light-Sensitive Material A in Example 1. The thus prepared Light-Sensitive Materials E to I were subjected to the same procedures and treatment as those in Example 1, thereby to obtain the results as shown in Table 2.

TABLE 2

| Light-Sensitive Material | Compound of Invention | $D_{max}$ | $D_{min}$ | Gradation* |
|---|---|---|---|---|
| E | A-1 | 1.95 | 0.11 | 1.6 |
| F | A-4 | 1.88 | 0.10 | 1.5 |
| G | A-5 | 2.0 | 0.13 | 1.7 |
| H | A-20 | 2.03 | 0.12 | 1.6 |
| I | B-1 | 2.0 | 0.14 | 1.7 |

*Note:
Same as in Table 1.

EXAMPLE 3

Light-Sensitive Materials J and K were prepared in the same manner as described for the preparation of Light-Sensitive Materials A and C in Example 1, respectively, except that a dye-releasing redox compound of the formula:

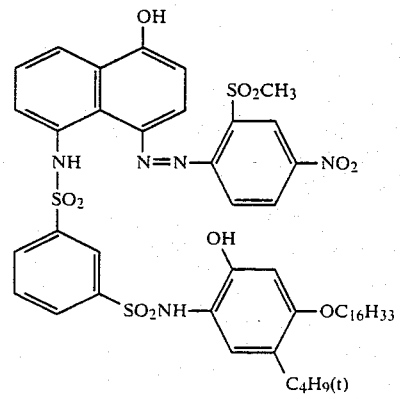

was used in place of the dye-releasing redox compound as used in Example 1.

Using the thus prepared light-sensitive materials, a cyan color image was obtained in the same manner as in Example 1. The density of the cyan color image to red light was determined and the results obtained are shown in Table 3.

TABLE 3

| Light-Sensitive Material | Compound of Invention | $D_{max}$ | $D_{min}$ |
|---|---|---|---|
| J | A-13 | 1.65 | 0.08 |
| K | none | 1.73 | 0.18 |

It can be proved from the results obtained in Examples 1 through 3 that the compounds of the present invention exhibit a conspicuous effect for obtaining a distinct color image and that such an effect is independent of the kind of dye-releasing redox compounds.

While the invention has been described in detail and with reference to specific embodiments thereof, it will be apparent to one skilled in the art that various changes and modifications can be made therein without departing from the spirit and scope thereof.

What is claimed is:

1. A process for forming an image which comprises heating a light-sensitive material comprising a support having thereon at least a light-sensitive silver halide, a binder and a dye releasing redox compound which is reductive to the light-sensitive silver halide and capable of releasing a hydrophilic dye upon reaction with the light-sensitive silver halide by heating, after imagewise exposure or simultaneously with imagewise exposure, in a substantially water-free condition in the presence of a compound having at least one group represented by the formula (A) or (B):

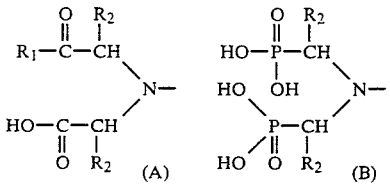

(A) (B)

wherein $R_1$ represents a hydroxyl group, an alkoxy group, an alkenyloxy group, an aryloxy group, or amino group, an N-alkylamino group, an N,N-dialkylamino group or an N-anilino group, and $R_2$ represents a hydrogen atom or an alkyl group, to imagewise form a mobile dye.

2. A process as claimed in claim 1, wherein said compound having at least one group represented by the formula (A) or (B) contains 1 to 6 groups represented by the formula (A) or (B).

3. A process as claimed in claim 1, wherein said compound having at least one group represented by the formula (A) or (B) contains other moieties selected from an alkane residue, an alkene residue, a cycloalkane residue, an aromatic residue, a heterocyclic residue and a combination thereof.

4. A process as claimed in claim 3, wherein $R_1$, $R_2$ and other moieties have a substituent selected from an alkyl group, a cycloalkyl group, an aralkyl group, an alkoxy group, an aryloxy group, an aryl group, an acylamino group, an acyl group, a cyano group, a hydroxyl group, an alkylsulfonylamino group, an arylsulfonylamino group, an alkylsulfonyl group, an arylsulfonyl group, a hydroxyalkyl group, a cyanoalkyl group, an alkoxycarbonyl group, an aryloxycarbonyl group, an alkoxycarbonylalkyl group, an alkoxyalkyl group, a nitro group, a halogen atom, a sulfamoyl group, an N-substituted sulfamoyl group, a carbamoyl group, an N-substituted carbamoyl group, an acyloxyalkyl group, an amino group, a substituted amino group, an alkylthio group, an arylthio group, a heterocyclic group, an alkoxycarbonylamino group, a carboxyl group and a sulfo group.

5. A process as claimed in claim 3, wherein said moiety is a residue of a compound represented by the formula (C):

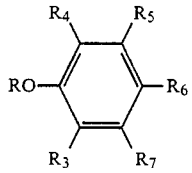

(C)

wherein $R_3$ represents a single chemical bond or a methylene group or a carbonyl group; $R_4$ has the same meaning as defined for $R_3$ and additionally represents a hydrogen atom, an alkyl group, an aryl group or a heterocyclic group; R represents a hydrogen atom or an alkyl group; $R_5$ and $R_7$ each represents a hydrogen atom, an alkyl group or an aryl group, or, when taken together with $R_6$, may form a ring and represents non-metallic atoms necessary to complete a condensed hetero ring together with the benzene ring; and $R_6$ represents an alkyl group, an aryl group, a hydroxycarbonyl group, an akylcarbonyl group, an acylamino group, an alkylsulfonyl group, an arylsulfonyl group, a carbamoyl group, a sulfonamido group, an amino group or an alkoxycarbonyl group; and each of R, $R_3$, $R_4$, $R_5$, $R_6$ and $R_7$ may have a substituent.

6. A process as claimed in claim 3, wherein said moiety is a substituted or unsubstituted alkyl group, a substituted or unsubstituted alkylene group, a divalent heterocyclic group, a heterocyclic group-substituted methyl group or a substituted or unsubstituted divalent cycloalkyl group.

7. A process as claimed in claim 1, wherein said compound having at least one group represented by the formula (A) or (B) is used in an amount of 0.0005 to 20 moles per mole of silver in the silver halide.

8. A process as claimed in claim 7, wherein said compound having at least one group represented by the formula (A) or (B) is used in an amount of 0.001 to 10 moles per mole of silver in the silver halide.

* * * * *